US007620195B2

(12) United States Patent
Bengtsson et al.

(10) Patent No.: US 7,620,195 B2
(45) Date of Patent: Nov. 17, 2009

(54) RECHARGEABLE HEARING AID

(75) Inventors: Bradley Dean Bengtsson, Mesa, AZ (US); Scott Raymond Fink, Apache Junction, AZ (US); Samuel L. Thomasson, Gilbert, AZ (US)

(73) Assignee: Zounds, Inc., Phoenix, AZ (US)

( * ) Notice: Subject to any disclaimer, the term of this patent is extended or adjusted under 35 U.S.C. 154(b) by 811 days.

(21) Appl. No.: 11/270,289

(22) Filed: Nov. 9, 2005

(65) Prior Publication Data

US 2007/0104343 A1 May 10, 2007

(51) Int. Cl.
*H04R 25/00* (2006.01)

(52) U.S. Cl. ..... 381/323; 381/314; 381/322

(58) Field of Classification Search ..... 381/323
See application file for complete search history.

(56) References Cited

U.S. PATENT DOCUMENTS 3,297,933 A 1/1967 McCarthy ..... 320/2
3,493,695 A 2/1970 Stork ..... 179/107
4,379,988 A * 4/1983 Mattatall ..... 320/108
5,876,425 A * 3/1999 Gord et al. ..... 607/56
6,310,960 B1 * 10/2001 Saaski et al. ..... 381/323
6,658,124 B1 * 12/2003 Meadows ..... 381/323
6,888,948 B2 5/2005 Hagen et al. ..... 381/314
2003/0171787 A1 9/2003 Money et al. ..... 607/57

* cited by examiner

*Primary Examiner*—Brian Ensey
*Assistant Examiner*—Matthew Eason
(74) *Attorney, Agent, or Firm*—Paul F. Wille

(57) ABSTRACT

A hearing aid having a rechargeable battery and a charger for charging the battery includes a first microphone and a first speaker in the hearing aid and a second microphone and a second speaker in the charger for acoustically transferring data between the hearing aid and the charger. The hearing aid can detect the charge state of a battery and send a signal to the charger indicative of the charge state. The charger also includes a chamber for receiving at least a portion of the hearing aid.

15 Claims, 1 Drawing Sheet

RECHARGEABLE HEARING AID

BACKGROUND

This invention relates to a hearing aid having at least one rechargeable battery, and in particular, to a recharging system that monitors the amount of charge in the battery during charging.

Hearing aids having rechargeable batteries have been known in the art for a long time; e.g., see U.S. Pat. No. 3,297,933 (McCarthy). The trade-off between rechargeable batteries and non-rechargeable batteries is the inconvenience of having to replace the battery. There is also a trade-off in capacity. A non-rechargeable battery lasts much longer than a rechargeable battery having the same outside dimensions as the non-rechargeable battery. This is due to the different chemistries of the two types of batteries.

The inconvenience of having to remove the battery from a hearing aid initially applied both to rechargeable batteries and non-rechargeable batteries. The sole advantage of rechargeable batteries was not having to be replaced. Then, chargers were developed that made electrical contact with the hearing aid, obviating the need to remove the rechargeable battery; e.g. see U.S. Pat. No. 3,493,695 (Stork). This simplified matters for those lacking the dexterity to remove and insert a battery. Having exposed electrical contacts is undesirable and inductive chargers solved this problem; e.g. see U.S. Pat. No. 4,379,988 (Mattatall).

Inductive chargers have their own set of difficulties, including adequate coupling between the primary inductor in the charger and the secondary inductor in the hearing aid; e.g. see U.S. Pat. No. 6,658,124 (Meadows). Even with adequate coupling, rechargeable batteries are not a panacea. Most rechargeable batteries, e.g. nickel cadmium, lithium ion, and others, have "memory." Memory in a battery relates to the amount of stored energy that it available after several discharge-charge cycles. If, for example, half the energy is used and a battery is recharged, then, eventually, only half the energy is available. Also, some rechargeable batteries do not like being overcharged, such as lithium ion batteries. These batteries overheat and rupture, sometimes violently, or catch fire. Currently, nickel-metal-hydride (NiMH) batteries are preferred for hearing aids because they have little memory and are more tolerant of overcharging.

The problems of memory and overcharging are particularly acute for hearing aids because a hearing aid may partially discharge a battery during the day and then be placed on a charger overnight. If more than one hearing aid is used, the batteries may be in different states of charge but are charged simultaneously.

It is known in the art that it is desirable to know the state of charge of a battery in a hearing aid; see Patent Application Publication US2003/0171787 (Money et al.). The published application refers to an "external controller" that "interrogates" a cochlear implant to determine the level of charge in a battery included in the implant.

It is known in the art to use a "wireless interconnection" to program hearing aids; see U.S. Pat. No. 6,888,948 (Hagen et al.). Transferring programming data to a hearing aid is disclosed. Transferring data from a hearing aid is not disclosed in the Hagen et al. patent, nor is controlling a charging cycle by communicating with a hearing aid.

In view of the foregoing, it is therefore an object of the invention to provide a rechargeable hearing aid that communicates with a charger to prevent overcharging.

Another object of the invention is to provide a battery charger and hearing aid that obviate the need for careful alignment of the hearing aid in the charger for optimum inductive coupling.

A further object of the invention is to provide a rechargeable hearing aid that can conduct two way communication with a charger.

SUMMARY OF THE INVENTION

The foregoing objects are achieved by this invention in which a hearing aid having a rechargeable battery and a charger for charging the battery include means for transferring data unidirectionally or bidirectionally between the hearing aid and the charger using either a magnetic field, light, or sound. The hearing aid includes means for detecting the charge state of a battery and for sending a signal to the charger indicative of the charge state. For acoustic coupling, the charger includes a microphone and a speaker and also includes a chamber for receiving at least a portion of the hearing aid.

BRIEF DESCRIPTION OF THE DRAWINGS

A more complete understanding of the invention can be obtained by considering the following detailed description in conjunction with the accompanying drawings, in which:

The FIGURE is a partial block, partial phantom drawing illustrating a preferred embodiment of the invention.

Figure 1:
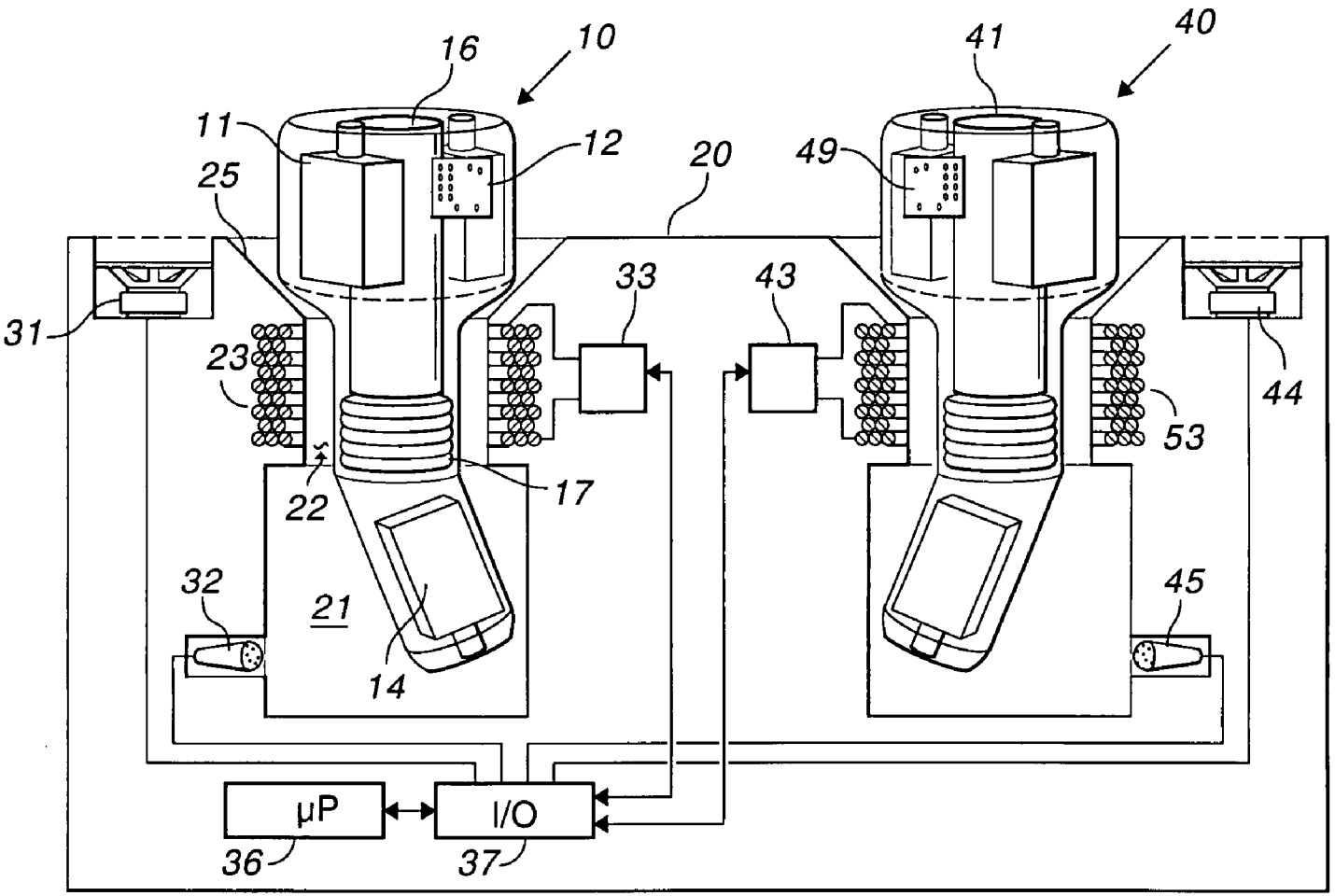

Those of skill in the art recognize that, once an analog signal is converted to digital form, all subsequent operations can take place in one or more suitably programmed microprocessors. Reference to "signal", for example, does not necessarily mean a hardware implementation or an analog signal. Data in memory, even a single bit, can be a signal. In other words, a block diagram can be interpreted as hardware, software, e.g. a flow chart or an algorithm, or a mixture of hardware and software. Programming a microprocessor is well within the ability of those of ordinary skill in the art, either individually or in groups.

DETAILED DESCRIPTION OF THE INVENTION

In the FIGURE, hearing aid 10 is inserted into charger 20 for charging. Although hearing aid 10 is illustrated as the type that is inserted into the ear, the invention can be used in other types of hearing aid, such as behind-the-ear hearing aids. Hearing aid 10 includes at least one microphone, such as microphone 11, a flex circuit or integrated circuit 12 containing a microprocessor for signal processing and other tasks, speaker 14, and rechargeable battery 16 for power. Beneath battery 16 is inductor 17, which is electrically coupled to circuit 12, as are the other electrical components. Dedicated electronics can be used instead of programmable electronics but programmable electronics are preferred.

The lower portion of hearing aid 10, containing speaker 14, fits easily within chamber 21. The middle portion of hearing aid 10 is located in chamber 22 within inductor 23. Inductor 17 and inductor 23 are more or less concentric but, as one of the advantages of the invention, alignment and position are not critical. The outer or upper portion of hearing aid 10 fits within conical depression 25, which provides a self-centering action for the type of hearing aid illustrated. Conical depression 25 terminates in chamber 22.

The actual charging operation is known in the art. Energy from inductor 23 is coupled to inductor 17, then converted to unidirectional or direct current (the current need not be steady but flows in one direction), then converted to chemical energy that is stored in the battery. Circuit 12 limits current or voltage, preferably both, to suitable values. In addition, circuit 12 monitors the condition of battery 16 to avoid overcharging. Depending upon battery type, one can monitor battery voltage or battery current during charging, interrupt charging to load the battery and monitor voltage during loading, or use other techniques, such as monitoring battery temperature, to prevent overcharging.

In accordance with the invention, a signal is provided to indicate full charge, whereby charger 20 terminates the charging cycle. Such signal is a minimal communication in accordance with the invention. Preferably, signals are given indicating intermediate states of charge, whereby, for example, the rate of charging can taper off as charging nears completion. Hearing aid 10 can communicate with the charger in several media. A first medium is a magnetic field, coupling electrical signals between inductors 17 and 23. Any frequency can be used but higher frequencies permit physically smaller inductors for a given impedance. Tens or hundreds of kilohertz are suitable. Radio frequencies can result in unlicensed emissions. Communicating by means of a magnetic field can be difficult during charging but is simpler during an interruption of the charging cycle, when the only signal on the inductors is data. A second medium is light, visible or invisible, using light emitting diode (LED) transmitters and photodiode receivers. This is not preferred because it requires additional components, requires a window in the hearing aid where space is at a premium, and consumes relatively high current for the LED transmitter in the hearing aid.

The preferred medium for communication is sound, using the microphone and speaker already in the hearing aid. In accordance with a preferred embodiment of the invention, charger 20 includes speaker 31 and microphone 32 for this purpose. Given the two-way communication between the charger and the hearing aid, there is no limit on the content of the communication. For example, the charger could also serve as an interface for programming a microprocessor in the hearing aid. Using suitable tones, or sets of tones, to represent logic ones and zeros, the hearing aid can transmit a first code indicating the level of charge and a second code indicating the rate of charge. If, for example, the coupling between inductors 17 and 23 happened to be particularly good, the hearing aid could "ask" the charger to reduce the current through inductor 23 to reduce the rate of charge, thereby preventing overheating.

As illustrated in the FIGURE, speaker 31 and microphone 32 are located adjacent chamber 21. Hearing aid 10 does not form a seal with charger 20 and there is sufficient coupling between speaker 31 and microphone 11. Speaker 31 can be located closer to microphone 11, if desired. If one wanted the charging to be inaudible, one could position speaker 31 closer to microphone 11 and put the speaker and the hearing aid in an enclosed space.

Power supply 33 provides charging power to hearing aid 10 by way of inductor 23. A signal at a current of a few tens of milliamperes and a frequency of 200 kHz-300 kHz is effective. Power supply 33 is controlled by and communicates with microprocessor 36 by way of input-output (I/O) interface 37. Interface 37 also drives speaker 31 and receives signals from microphone 32. While shown as separate elements, it is known in the art that many commercially available microprocessors have analog inputs and include analog to digital (A/D) converters on the same semiconductor chip as the computer portion of the microprocessor. Thus, "microprocessor" is intended to include computing and logic capability and suitable I/O, whether on a single chip or on plural chips.

As illustrated in the FIGURE, charger 20 includes receptacles for two hearing aids. Hearing aid 40 includes battery 41, which is charged by power supply 43 under the control of microprocessor 36. Although the operation is the same, the charging of battery 41 is completely independent of the charging of battery 16. Hearing aid 40 does not have to be inserted into charger 20 at the same time as hearing aid 10 and need not even have the same type of battery. Communicating by way of speaker 44 and microphone 45, the charging of battery 41 is monitored by circuit 49. Ultimate control of the charging process is preferably in the hearing aid, which makes the system extremely flexible. Alternatively, control can be shared as desired; e.g., if memory space is limited. For example, default or starting conditions for charging can be programmed into the charger or the hearing aid can set starting conditions.

The presence of a hearing aid can be detected by power supply 33 or power supply 43, for example, by sensing a change in inductance in inductor 23 or inductor 53. Alternatively, presence can be sensed acoustically by recognizing the sound of a hearing aid being inserted into charger 20 or by a difference in sound between microphones 32 and 45. Other acoustic or magnetic presence detectors can be used instead. More simply, one can simply use a switch (not shown) for each receptacle to alert microprocessor 36 that a hearing aid has been inserted and to begin a charging cycle for that receptacle.

The invention thus provides a rechargeable hearing aid that communicates with a charger to prevent overcharging. There is no need for careful alignment of the hearing aid in the charger for optimum inductive coupling. The communication between the hearing aid and the charger can be one-way or two-way and can include programming or other data, in addition to or instead of data for charging. Hearing aids in any state of charge can be put into the charger and be charged correctly, without any danger of overcharging or undercharging (unless removed too soon).

Having thus described the invention, it will be apparent to those of skill in the art that various modifications can be made within the scope of the invention. For example, the shape of the charger and the shape of the hearing aid is not critical so long as some inductive coupling takes place for charging. As described above, the invention can be implemented in hearings aid of other forms, such as behind the ear hearing aids. Although the battery is preferably NiMH, other batteries can be used instead. For nickel cadmium batteries, a charging cycle should begin by discharging the battery to avoid memory problems. Although illustrated as below the battery, an inductor can be located in any available space within a hearing aid, including around at least a portion of the battery. An indication of partial charge can be used to terminate a charging cycle if one is unconcerned about memory problems or if the battery does not exhibit memory. Suitable indicators, such as variously colored LEDs, can be added as desired to indicate the states of operation of the charger. Even rechargeable batteries wear out. The hearing aid can be programmed to test its battery to determine whether or not the battery should be replaced; e.g. because of memory problems. This information is then sent to the charger, which can provide a suitable alarm or indication to the user. Programs can be stored temporarily or permanently in the hearing aid.

What is claimed as the invention is:

1. In a hearing aid having a rechargeable battery and a charger for charging the battery, the improvement comprising:

a first microphone and a first speaker in said hearing aid and a second microphone and a second speaker in said charger for acoustically transferring data between the hearing aid the charger.

2. The hearing aid and charger as set forth in claim 1 wherein the transfer of data is unidirectional.

3. The hearing aid and charger as set forth in claim 2 wherein the transfer of data is from the hearing aid to the charger.

4. The hearing aid and charger as set forth in claim 1 wherein the transfer of data is bidirectional.

5. The hearing aid and charger as set forth in claim 1 wherein the data is programming data for the hearing aid.

6. The hearing aid and charger as set forth in claim 1 wherein the battery is nickel metal hydride.

7. The hearing aid and charger as set forth in claim 1 wherein said hearing aid includes a first inductor and said charger includes a second inductor, wherein energy is transferred to the battery for storage by means of said first inductor and said second inductor.

8. The hearing aid and charger as set forth in claim 7 wherein said charger includes a receptacle for holding the first inductor proximate the second inductor for magnetic coupling therebetween.

9. The hearing aid and charger as set forth in claim 7 wherein the medium is a magnetic field and the means for transferring data includes said first inductor and said second inductor.

10. The hearing aid and charger as set forth in claim 1 wherein said hearing aid includes means for detecting the condition of the battery and for sending a signal to said charger, using said means for transferring data, representative of that condition.

11. The hearing aid and charger as set forth in claim 1 wherein said hearing aid includes means for detecting when the battery is charged and for sending a signal to said charger, using said means for transferring data, that the battery is charged.

12. The hearing aid and charger as set forth in claim 1 wherein said charger includes a chamber for receiving at least a portion of the hearing aid containing said speaker.

13. The hearing aid and charger as set forth in claim 1 wherein said charger includes at least two receptacles for receiving hearing aids.

14. The hearing aid and charger as set forth in claim 1 wherein said charger includes a microprocessor and said microprocessor monitors the charge state of said battery from data transferred by said means for transferring data.

15. A method for recharging a rechargeable battery in a hearing aid using a charger, said method comprising the steps of:

acoustically transferring data between the hearing aid and the charger; and charging the battery in accordance with the data.

* * * * *